US008246381B1

(12) United States Patent
Sun

(10) Patent No.: US 8,246,381 B1
(45) Date of Patent: Aug. 21, 2012

(54) ADAPTER

(75) Inventor: Zheng-Heng Sun, New Taipei (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/169,043

(22) Filed: Jun. 27, 2011

(30) Foreign Application Priority Data

Apr. 13, 2011 (CN) ..... 2011 1 0091788

(51) Int. Cl.
*H01R 13/60* (2006.01)

(52) U.S. Cl. ..... 439/537

(58) Field of Classification Search ..... 439/638, 439/537, 949
See application file for complete search history.

(56) References Cited

U.S. PATENT DOCUMENTS 6,581,123 B1 * 6/2003 Pua ..... 710/302
* cited by examiner

*Primary Examiner* — Phuong Dinh
(74) *Attorney, Agent, or Firm* — Altis Law Group, Inc.

(57) ABSTRACT

A disk drive adapter which includes an enclosure, a circuit board, and two mounting pieces extending forwards. A first connector provides connections which match the I/O connections of the disk drive, as the disk drive is securely latched and held between the mounting pieces.

5 Claims, 7 Drawing Sheets

ADAPTER

BACKGROUND

1. Technical Field

The present disclosure relates to an adapter for hard disk drives.

2. Description of Related Art

The storage space of an internal hard disk drive of a computer is limited, which sometimes cannot meet storage needs. Therefore, an external hard disk drive is often used to store information. When using the external hard drive, the external hard drive is first installed in an adapter, and the adapter is connected to an interface of the computer. However, in use, the adapter needs to be repeatedly disassembled and assembled to enclose or remove the hard disk drive, which is very inconvenient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
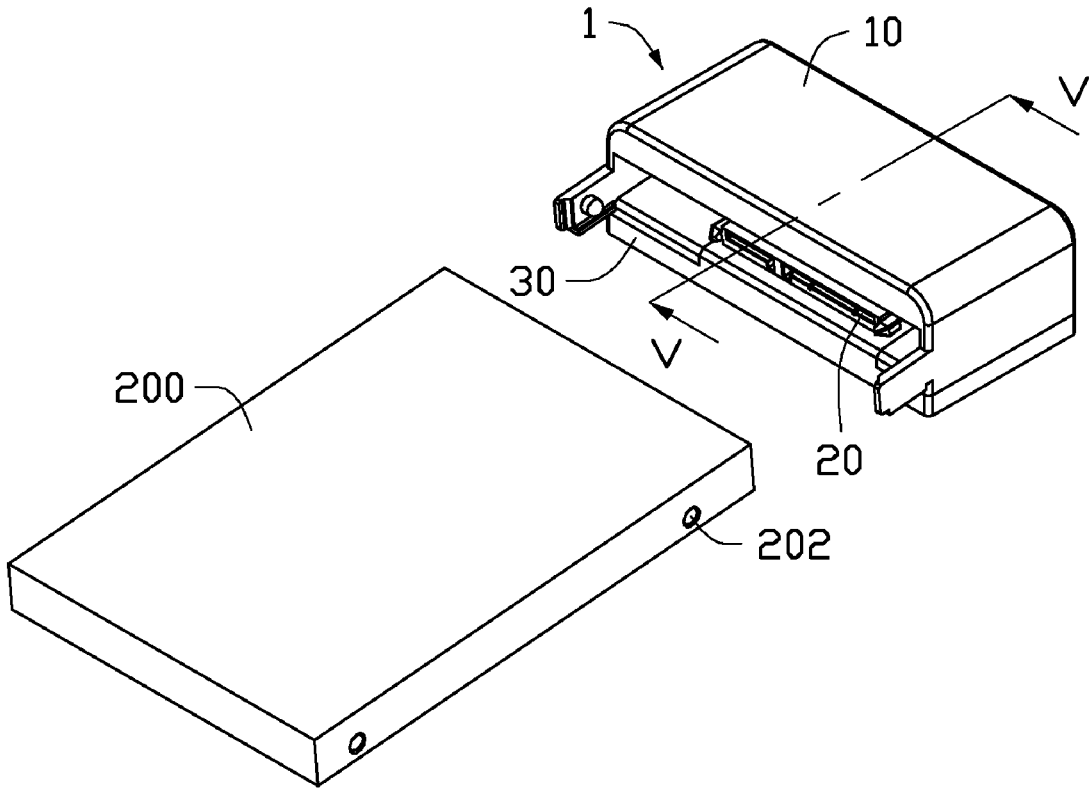
FIG. 1 is an exploded, isometric view of an exemplary embodiment of an adapter, and a hard disk drive.
Figure 2:
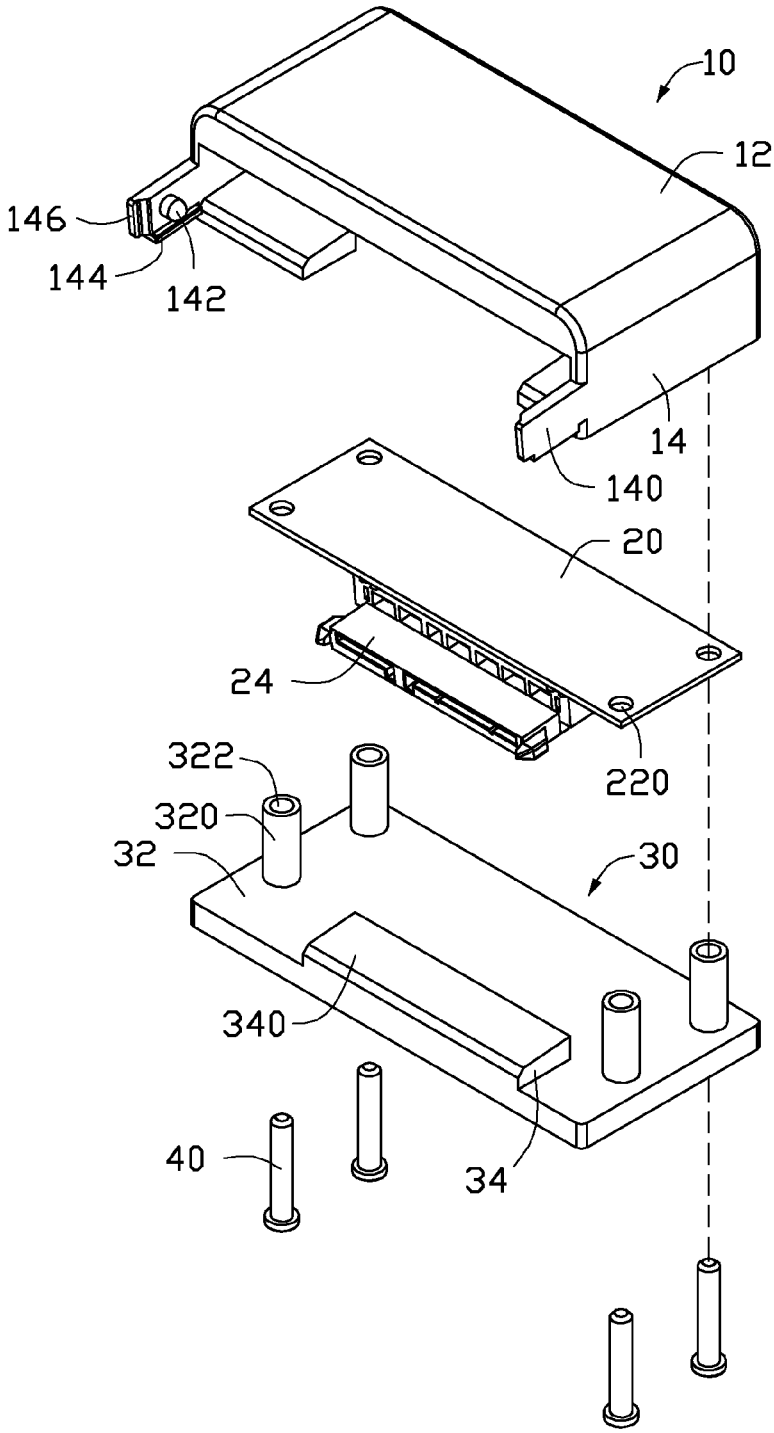
FIG. 2 and FIG. 3 are exploded, isometric views of the adapter of FIG. 1, but viewed from different perspectives.
Figure 3:
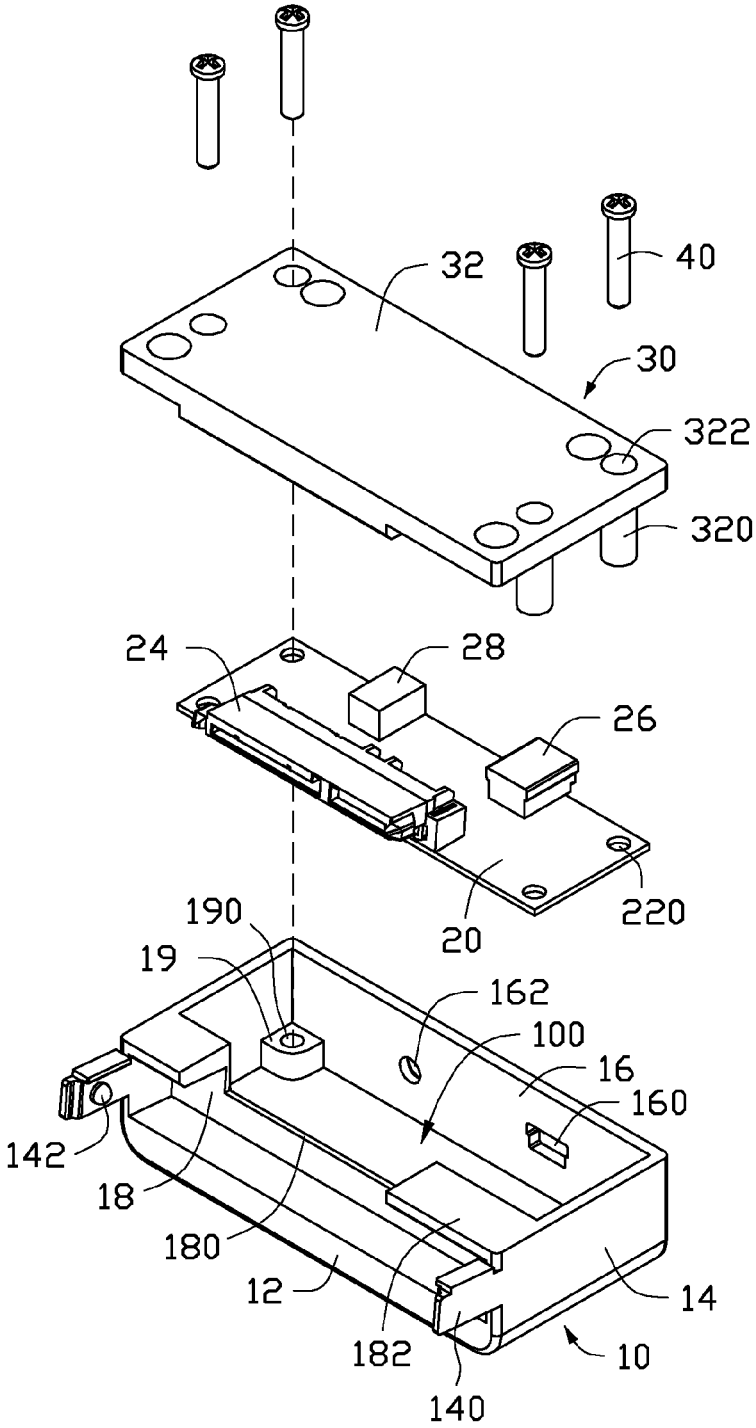

The disclosure, including the accompanying drawings, is illustrated by way of example and not by way of limitation. It should be noted that references to "an" or "one" embodiment in this disclosure are not necessarily to the same embodiment, and such references mean at least one.

Referring to FIGS. 1 to 3, and 5, an exemplary embodiment of an adapter 1 is provided to connect a hard disk drive 200 to an electronic device (not shown). The adapter 1 includes a cover 10, a circuit board 20, a seat 30, and a plurality of fasteners 40. In this embodiment, each fastener 40 is a screw.

The cover 10 includes a top plate 12, two end plates 14 substantially perpendicular extending from the two opposite ends of the top plate 12 and opposing each other, a rear plate 16 substantially perpendicular extending from the rear side of the top plate 12, and a limiting plate 18 extending down from a front side of the top plate 12. A receiving space 100 is bounded by the top plate 12, the end plates 14, the rear plate 16, and the limiting plate 18. Four mounting blocks 19 extend down from the top plate 12, located in the four corners of the receiving space 100. Each mounting block 19 defines a mounting hole 190. In this embodiment, the mounting hole 190 is a threaded hole. Two mounting pieces 140 extend forward from the front ends of the end plates 14. Two protrusions 142 extend toward each other from the mounting pieces 140. A guiding piece 144 substantially perpendicular extends from the bottom of the inner side of each mounting piece 140, toward the other mounting piece 140. An operation portion 146 is formed on the extremity of each mounting piece 140, opposite to the corresponding end plate 14. The rear plate 16 defines a first through hole 160 and a second through hole 162. The limiting plate 18 defines an opening 180, opposite to the top plate 12. Two tabs 182, substantially parallel to the top plate 12, extend forwards from the base of the limiting plate 18 on either at two opposite side of the opening 180.

The circuit board 20 defines four though holes 220 in the four corners. A first connector 24 extends from a front side of the circuit board 20. A second connector 26 and a third connector 28 extend from the rear of the circuit board 20. In this embodiment, the first connector 24 is a serial advanced technology attachment (SATA) connector. The second connector 26 is a universal serial bus (USB) connector of any standard size. The third connector 28 is a power connector. The first connector 24 includes a mounting portion 240 mounted on the bottom of the front side of the circuit board 20, and an electrical connection portion 242 extending from the mounting portion 240 (see FIG. 5). The connection portion 242 is slanted down from the circuit board 20.

The seat 30 includes a substantially rectangular bottom plate 32. A guiding block 34 extends from a front side of the bottom plate 32. Four mounting posts 320 extend from the four corners of the bottom plate 32. Each mounting post 320 axially defines a through hole 322, extending through the bottom plate 32. The guiding block 340 includes a guiding surface 340 at its top, slanted down from the horizontal to accommodate the connection portion 242.

Figure 4:
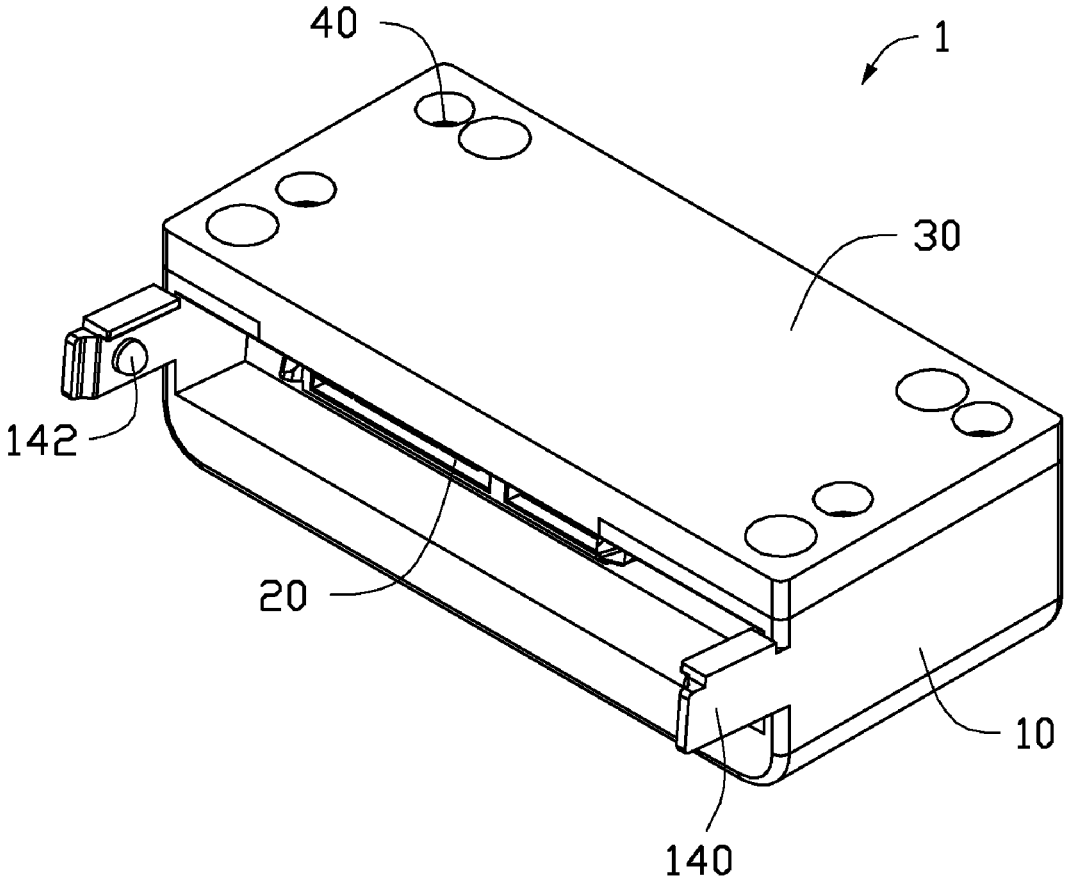
FIG. 4 is an assembled, isometric view of FIG. 3.
Figure 5:
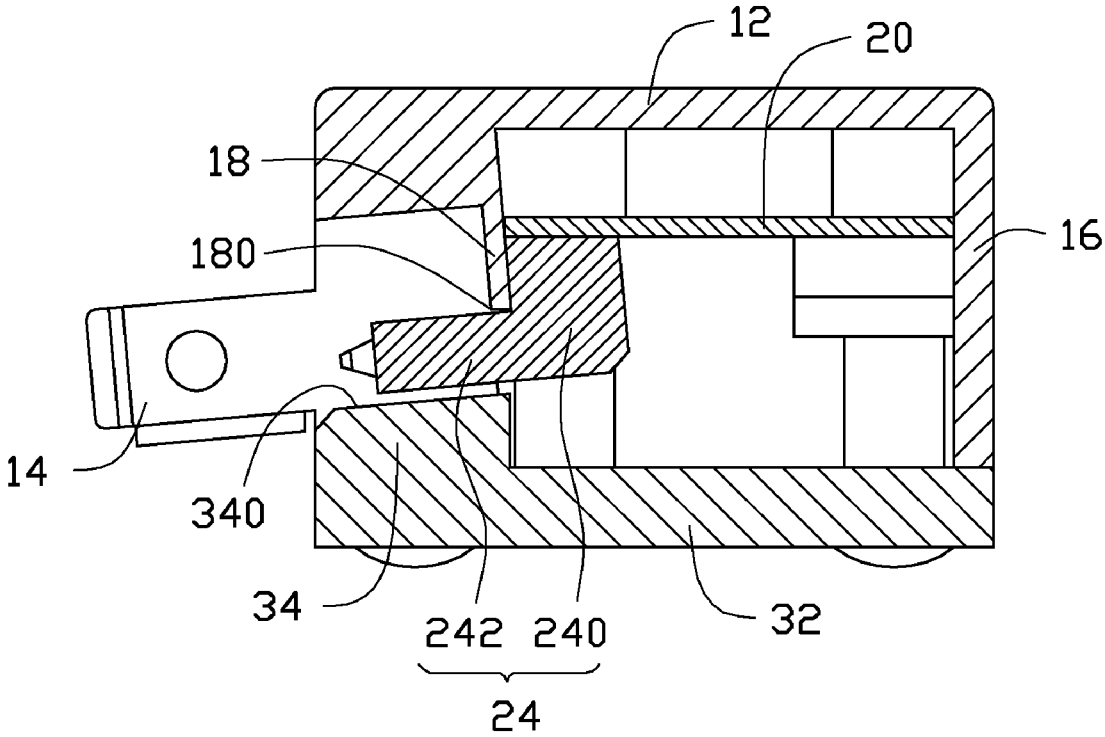
FIG. 5 is a sectional view of the adaptor of FIG. 1, taken along the line of V-V.

Referring to FIGS. 4 and 5, in assembly, the circuit board 20 is received in the receiving space 100 and is in contact with the faces of the mounting blocks 19, the through holes 220 aligning with the corresponding mounting holes 190. The connection portion 242 of the first connector 24 extends through the opening 180 of the limiting plate 18. The second connector 26 and the third connector 28 respectively align with the first through hole 160 and the second through hole 162. The seat 30 is attached to the bottom of the cover 10, with the mounting posts 320 of the seat 30 in contact with the circuit board 20. The though holes 322 align with the corresponding through holes 220. The end plates 14 and the rear plate 16 precisely locate the bottom plate 32. At both ends of the guiding block 34, the bottom plate 32 rests on the two tabs 182. The fasteners 40 extend through the through holes 322 and 220 to engage in the mounting holes 190, to hold the cover 10, the circuit board 20, and the seat 30 firmly in place. The connection portion 242 is parallel to and almost butting against the guiding surface 340.

Figure 6:
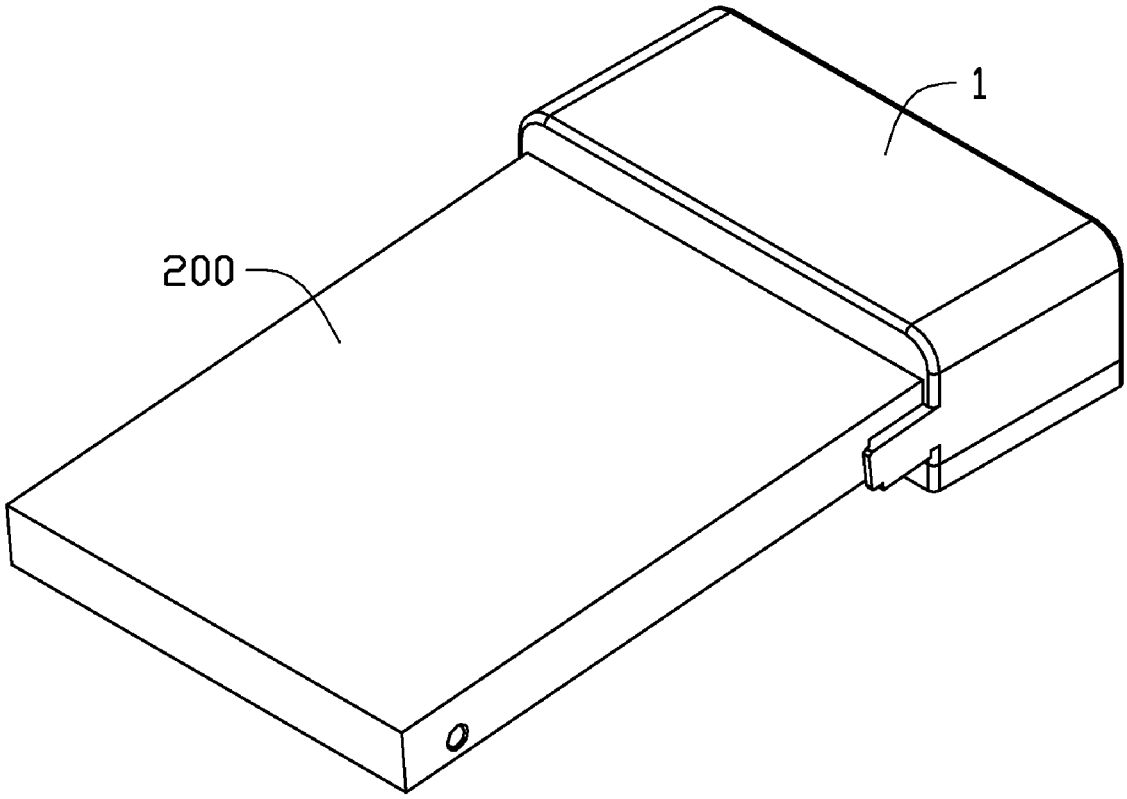
FIG. 6 is an assembled, isometric view of adapter and the hard disk drive of FIG. 1.
Figure 7:
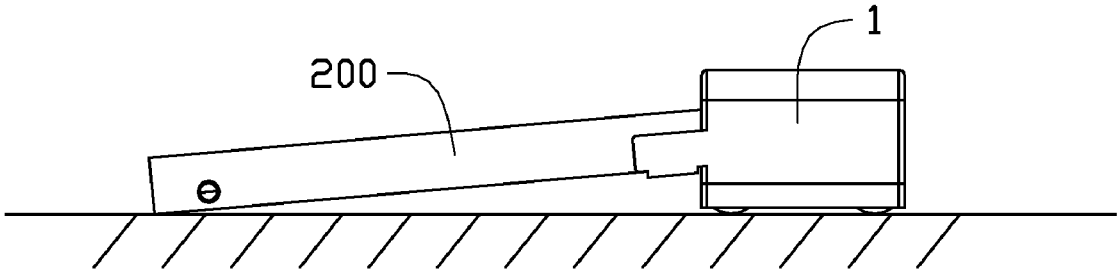
FIG. 7 is a side plan view of adapter and the hard disk drive of FIG. 6.

Referring to FIGS. 6 and 7, in use, the hard disk drive 200 is supported on the guiding pieces 144 to slide into the adapter 1, which operation elastically spreads the mounting pieces 140. An interface (not shown) of the hard disk drive 200 is plugged into the connection portion 242 for an electrically connection with the first connector 24. As the protrusions 142 latch into the two mounting holes 202 at opposite sides of the hard disk drive 200, the hard disk drive 200 is mounted to the adapter 1. The second connector 26 can be electrically connected to an electronic device, such as a computer. The third connector 29 can be electrically connected to a power supply.

Because the connection portion 242 is angled relative to the circuit board 20, only one end of the hard disk drive 200 is in contact with the user's work surface, facilitating the dissipation of heat from the hard disk drive 200.

It is believed that the present embodiment and its advantages will be understood from the foregoing description, and it will be apparent that various changes may be made thereto without departing from the spirit and scope of the description or sacrificing all of their material advantages, the examples hereinbefore described merely being exemplary embodiments.

What is claimed is:

1. An adapter for a hard disk drive, comprising:

an enclosure;

a circuit board enclosed in the enclosure, and comprising a first connector extending from a front side of the circuit board and exposed through a front side of the enclosure to be connected to the hard disk drive;

two mounting pieces extending forward from two opposite ends of the adapter; and two protrusions extending toward each other from the mounting pieces, respectively;

wherein when the hard disk drive is mounted to the adapter, clamped between the mounting pieces, and electrically connected to the first connector, the protrusions are latched in two mounting holes in opposite sides of the hard disk drive;

wherein the enclosure comprises a seat and a cover covered on the seat to enclose the circuit board;

wherein the cover comprises a top plate, two end plates substantially perpendicularly extending down from two opposite ends of the top plate, a rear plate substantially perpendicularly extending down from a rear side of the top plate, and a limiting plate extending down from a front side of the top plate, the top plate, end plates, rear plate, and limiting plate together bind a receiving space accommodating the circuit board;

wherein the limiting plate defines an opening opposite to the to plate through which the first connector extends to be exposed; and wherein the first connector comprises a mounting portion mounted on the circuit board, and an electrical connection portion extending from the mounting portion, the connection portion is angled with the circuit board and extends through the opening, the seat comprises a bottom plate, and a guiding block extending from a front side of the bottom plate, the guiding block comprises a guiding surface angled with the bottom plate, an angle between the guiding surface and the bottom plate is equal to an angle between the connection portion and the circuit board, thereby the connection portion is parallel to the guiding surface, and the hard disk drive is operable to be plugged into the connection portion along the guiding surface, to be electrically connected to the first connector, the hard disk drive is angled with the bottom plate of the seat.

2. The adapter of claim 1, wherein two tabs extend from a bottom of the limiting plate, at two opposite ends of the opening, parallel to the top plate, resisting against the bottom plate and located at opposite ends of the guiding block.

3. The adapter of claim 1, wherein four mounting blocks extend from the top plate, located in four corners of the receiving space, each mounting block defines a mounting hole, the circuit board defines four first though holes in four corners, four mounting posts extend from four corners of the bottom plate, each mounting post axially defines a second through hole, through the bottom plate, the circuit board contacts the mounting blocks, the mounting posts contact the circuit board, four fasteners extend through the second through holes and the first through holes to engage in the mounting holes to mount the cover, the circuit board, and the seat together.

4. The adapter of claim 1, wherein a second connector and a third connector extend from a rear side of the circuit board opposite to the first connector, the rear plate defines a third though hole and a forth through hole, respectively aligning with the second connector and the third connector.

5. The adapter of claim 1, wherein the mounting pieces extend from front sides of the end plates, a guiding piece substantially perpendicularly extends from a bottom of an inner side of each mounting piece, for supporting the hard disk drive.

* * * * *